US005829553A

United States Patent [19]

Wan et al.

[11] Patent Number: 5,829,553

[45] Date of Patent: Nov. 3, 1998

[54] FAIL-SAFE MOVEMENT OF ELEVATOR CABS BETWEEN CAR FRAMES AND LANDINGS

[75] Inventors: Samuel C. Wan, Simsbury; Bruce A. Powell, Canton; Paul Bennett, Waterbury; Anthony Cooney, Unionville; Richard C. McCarthy, Simsbury; Joseph Bittar, Avon; Frederick H. Barker, Bristol; LucyMary Salmon, South Windsor, all of Conn.

[73] Assignee: Otis Elevator Company, Farmington, Conn.

[21] Appl. No.: 663,869

[22] Filed: Jun. 19, 1996

Related U.S. Application Data

[63] Continuation-in-part of Ser. No. 564,704, Nov. 29, 1995.

[51] Int. Cl.[6] ..... B66B 11/02

[52] U.S. Cl. ..... 187/401; 187/249; 187/414

[58] Field of Search ..... 187/401, 902, 187/249, 282, 289, 414, 250, 391

[56] References Cited

U.S. PATENT DOCUMENTS

| | | | |
|---|---|---|---|
| 1,939,729 | 12/1933 | Stark | 187/1 |
| 1,949,399 | 3/1934 | Ayer | 187/1 |
| 2,052,690 | 9/1936 | Austin | 187/249 |
| 3,447,704 | 6/1969 | Guilbert, Jr. | 214/95 |
| 5,090,515 | 2/1992 | Takahashi et al. | 187/249 |
| 5,601,156 | 2/1997 | McCarthy et al. | 187/249 |

FOREIGN PATENT DOCUMENTS

| | | | |
|---|---|---|---|
| 3-272987 | 12/1991 | Japan | 187/289 |
| 3-279186 | 12/1991 | Japan | 187/289 |
| 4-361968 | 12/1992 | Japan . | |
| 5-162947 | 6/1993 | Japan | 187/298 |
| 6-156939 | 6/1994 | Japan | 187/289 |

OTHER PUBLICATIONS

Strackosch, G.R.; "Vertical Transportation: Elevators and Escalators"; pp. 472–475; New York: 1983.

*Primary Examiner*—Robert Nappi

[57] ABSTRACT

A first slidable auxiliary pinion (58*a*) on the bottom of a horizontally moveable elevator cab A (FIGS. 2–6) disposed on a car frame (14) or a landing is moved out from under the cab toward another car frame (13) or landing by means of a motorized pinion (56) until it engages a motorized pinion (57) on the adjacent car frame (13) or landing, which then pulls the auxiliary pinion and the entire cab toward the other car frame or landing until a main rack (45) fixed to the bottom of the cab engages a motorized pinion (34) on the other car frame (13) or landing, which pinion then pulls the entire cab onto the other car frame or landing. The auxiliary racks (58*a*, 58*b*) may be mounted on a common auxiliary rack member (58), or may be separate. The auxiliary motorized pinions (55, 56, 57) may be bidirectional, or may be; and auxiliary pinions (32C, 33C, 34C) may be; mounted on the same shaft with main pinions (32*b*, 33*b*, 34*b*).

15 Claims, 13 Drawing Sheets

FAIL-SAFE MOVEMENT OF ELEVATOR CABS BETWEEN CAR FRAMES AND LANDINGS

This is a continuation-in-part of application Ser. No. 08/564,704, filed Nov. 29, 1995, now abandoned.

TECHNICAL FIELD

This invention relates to horizontal motive means for drawing a horizontally moveable elevator cab onto an elevator car frame or onto a landing.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMS are not yet practical, principally because, without a counterweight, motor components and energy consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in a commonly owned, copending U.S. patent application Serial No. (Attorney Docket No. OT-2230), filed contemporaneously herewith. The loading and unloading of passengers takes considerable time, in contrast with high speed express runs of elevators.

DISCLOSURE OF INVENTION

Objects of the invention include provision of means for moving a horizontally moveable elevator cab between elevator car frames and between landings and elevator car frames; and moving a plurality of adjacent elevator cabs simultaneously.

In accordance with the invention, a horizontal motive means moves an elevator cab from one platform to an adjacent platform.

According to the present invention, a member, such as a slidable auxiliary rack is moved outwardly from underneath an elevator cab so that it engages a means, such as a pinion on an adjacent platform (an elevator car frame, a landing, or a cab carrier); the means (pinion) then pulls the auxiliary rack and the entire cab toward the adjacent platform until another member, such as a main rack fixed to the bottom of the cab, engages the means (pinion) on the platform; then the means (pinion) pulls the other member (main rack) and the entire cab fully onto the adjacent platform. According to the invention, an auxiliary rack for moving to the right may be mounted on the same rack member with one for moving to the left. According to the invention further, an auxiliary rack for moving the cab to the right may be separate from an auxiliary rack for moving the cab to the left.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
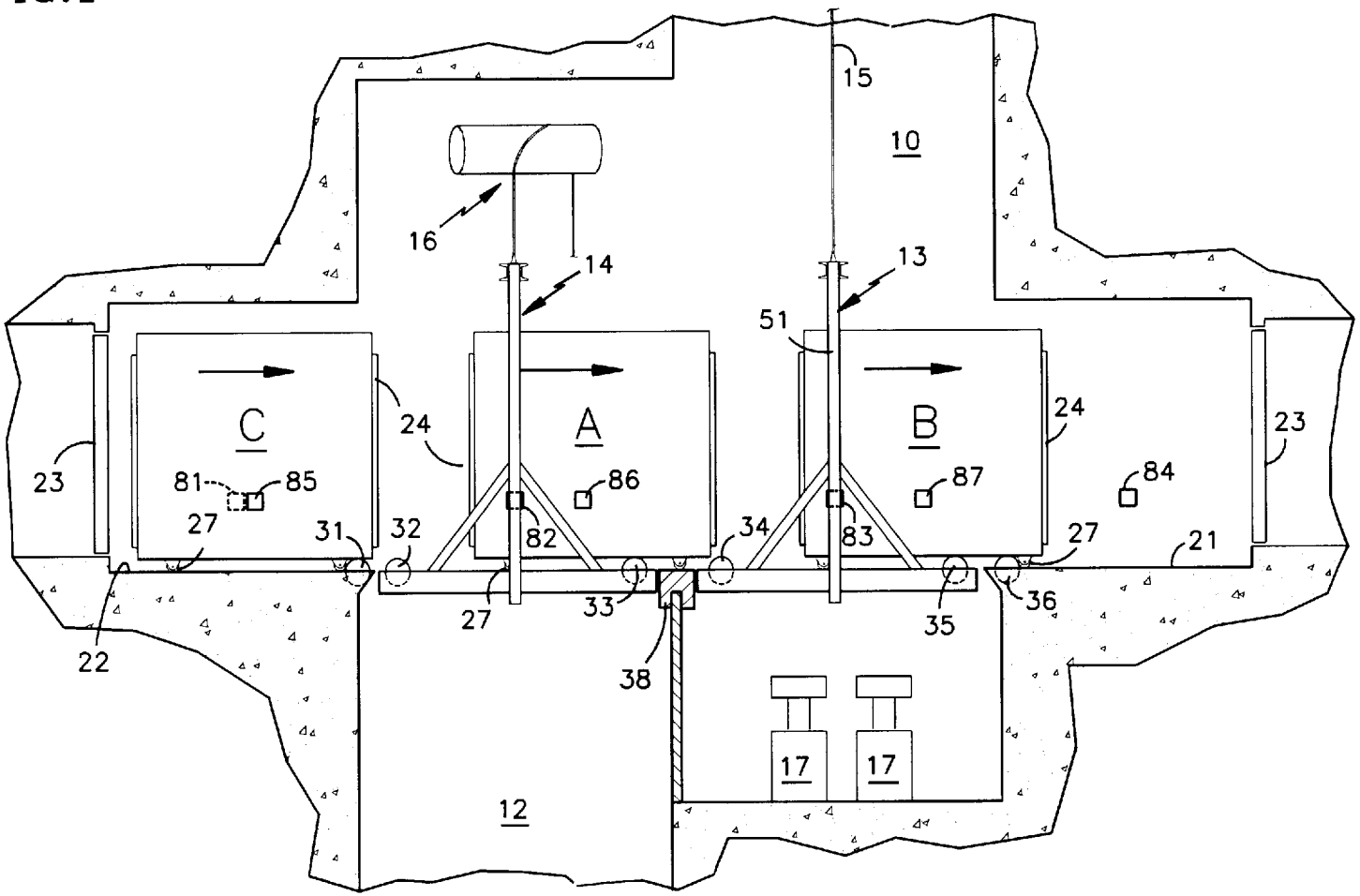
FIG. 1 is a partial, simplified and stylized, side elevation cross section of a pair of overlapping elevator shafts with cabs moving between the car frames and landings, according to the invention.

Referring now to FIG. 1, the present invention may be used, for example, in an elevator system having a pair of hoistways 10, 12, each for moving an elevator car frame 13, 14 up and down in a hoistway by means of a roping system 15, 16. The hoistway may have the usual buffers 17. Depicted in FIG. 1 is a transfer floor at the terminal ends of the hoistways 10, 12 where elevator cabs C, A, B may be transferred between the car frames 13, 14 as well as to and from landings 21, 22. The landings have conventional hoistway doors 23 operated in the conventional fashion by elevator car doors 24. The elevators have wheels or rollers 27, typically at each of the four corners of each cab, to allow the cabs to roll horizontally, between left and right as seen in FIG. 1. The landings and car frames have motorized pinions 31–36 at each interface across which a cab may be pulled. Thus, assuming that the cabs are moving to the right as shown by the arrows thereon, cab C will have previously been pulled onto landing 22 by motorized pinion 31 at the same time that cab A was pulled onto car frame 14 by motorized pinion 33 at the same time that cab B was pulled onto car frame 13, across a sill 38, by motorized pinion 35. In the present movement to the right, cab B will be pulled onto landing 21 by motorized pinion 36, cab A will be pulled onto car frame 13 by motorized pinion 34, and cab C will be pulled onto car frame 14 by motorized pinion 32. The invention may also be utilized to pull cabs between landings and a single car frame, between landings and three car frames, all as is disclosed in a commonly owned copending U.S. patent application Serial No. (Attorney Docket No. OT-2296), filed contemporaneously herewith, or simply between a pair of car frames, as is disclosed in a commonly owned copending U.S. patent application Serial No. (Attorney Docket No. OT-2230), filed contemporaneously herewith.

It is evident in FIG. 1 that motorized pinions 32, 34 has not yet engaged cabs C and A. Although normally the cabs will be operated in complete synchronism, for the purposes of illustration and clarity, cab B is shown in a position where it has already been engaged by motorized pinion 36.

Figure 2:
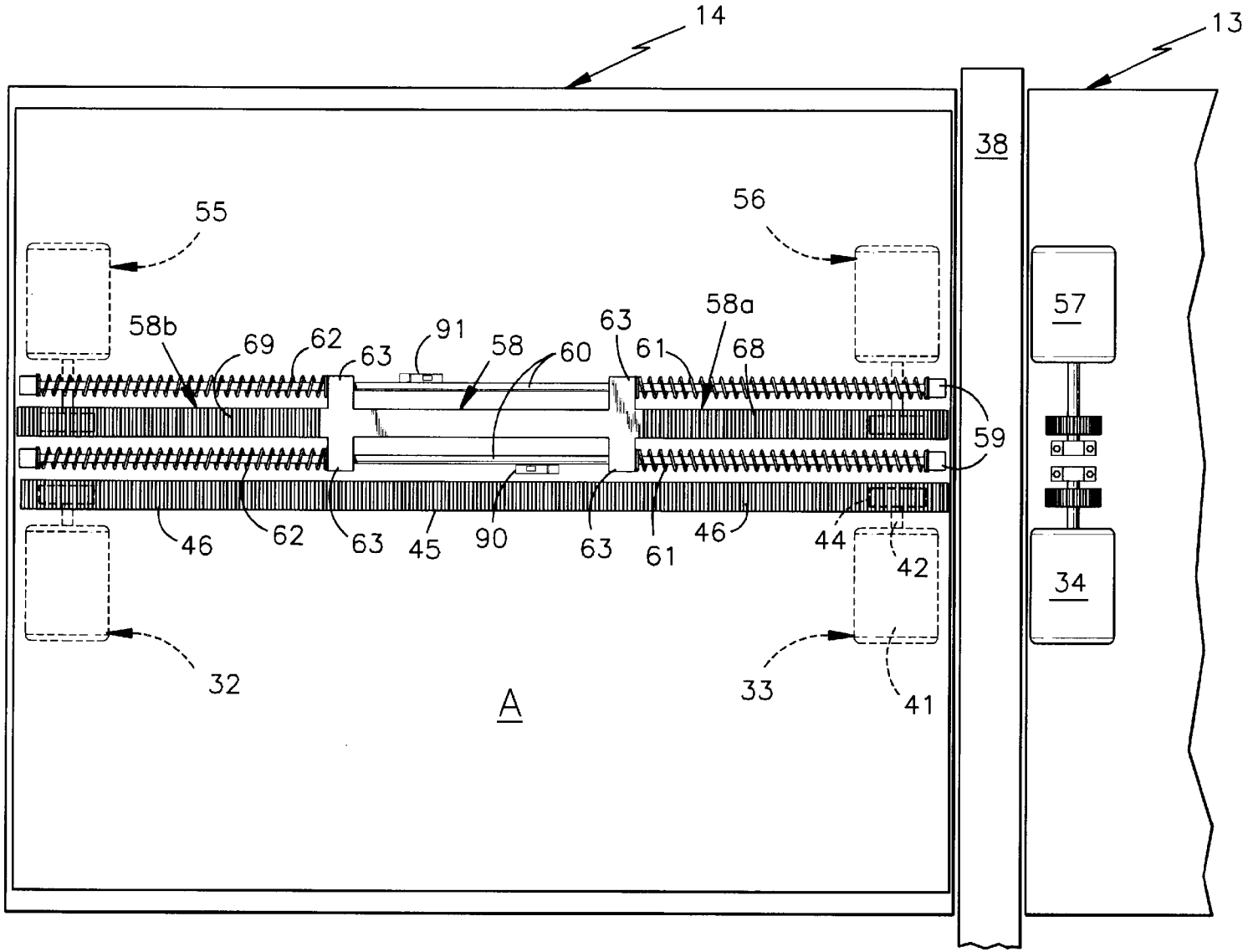
FIG. 2 is a simplified and stylized, top plan view of a horizontal elevator cab motion means according to the invention.
Figure 3:
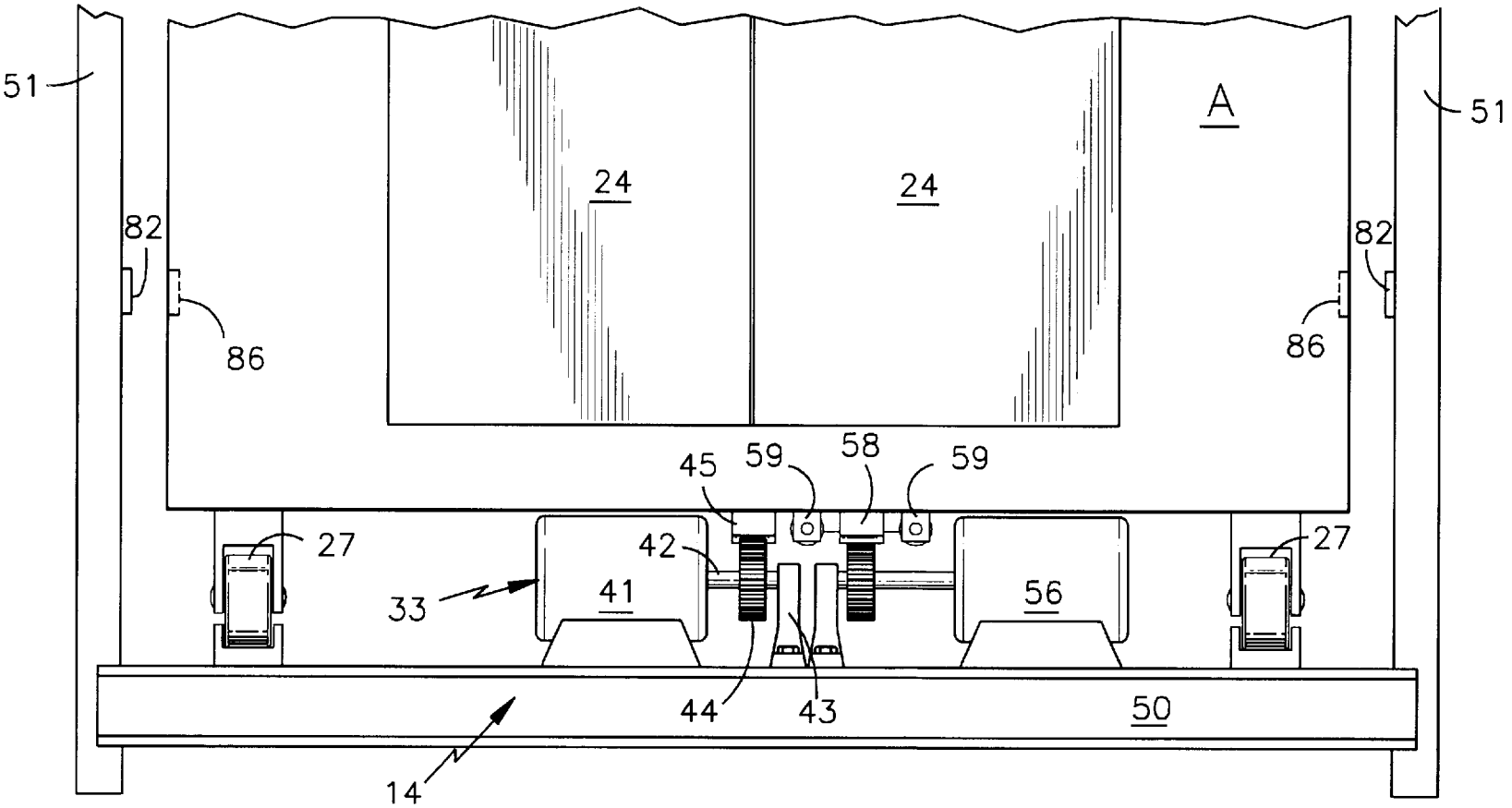
FIG. 3 is a partial, stylized and simplified end elevation view of the apparatus of FIG. 2.

As described more fully hereinafter, the pinions on the motorized pinion assemblies 31–36 each operate only in a direction to pull a cab toward it: the pinions associated with the motorized pinion assemblies 31, 33 and 35 rotating only anti-clockwise, and the pinions associated with the motorized pinion assemblies 32, 34 and 36 rotating only clockwise, as viewed in FIG. 1. FIG. 2 is a stylized view, looking upwardly through the car frames 13, 14 and looking at some of the apparatus on the bottom of cab A. The motorized pinion assemblies 32 and 33 are shown in phantom so as not to obscure the rack assemblies which are disposed on the bottom surface of the cab platform. As seen more clearly in FIG. 3, the motorized pinion assembly 33 includes an electric motor 41 having a shaft 42 journaled in a pillow block 43 and driving a pinion 44 which engages a main rack 45 which has teeth 46 throughout its length. The motorized pinion 32 (FIG. 2) engages the other end of the main rack 45. The motorized pinions 33, 32, pillow block 43, and similar apparatus may be mounted on a platform or other framing structure atop the plank 50 of the car frame 14. The car frame 14 may have the usual stiles 51, which extend below the plank and may support safeties, in the normal fashion. In other respects, the car frames 13 and 14 may be similar in all respects to well known elevator car frames, except for not having a cab permanently built thereon.

Referring again to FIGS. 2 and 3, the landings 21, 22 and the car frames 13, 14 have auxiliary motorized pinions 55–57 which are similar in all respects to the motorized pinions 27–36 except that the pinions are bidirectional and the shafts may be longer to accommodate auxiliary racks 58*a*, 58*b* disposed at opposite ends of an auxiliary rack member 58 driven thereby. While the main rack 45 is firmly secured to the base of the cab, and has no relative motion with respect to the cab, the auxiliary rack member 58 is suspended beneath the cab on four lugs 59 by means of a pair of rods 60 which pass through pairs of compression springs 61, 62. The auxiliary rack member 58 has four lugs 63 which engage the springs 61, 62 and which support the auxiliary rack 58 on the rods 60. Thus, the auxiliary rack member 58 is free to slide to the right or the left against the compressive force of either the springs 61 or the springs 62, respectively.

Figure 4:
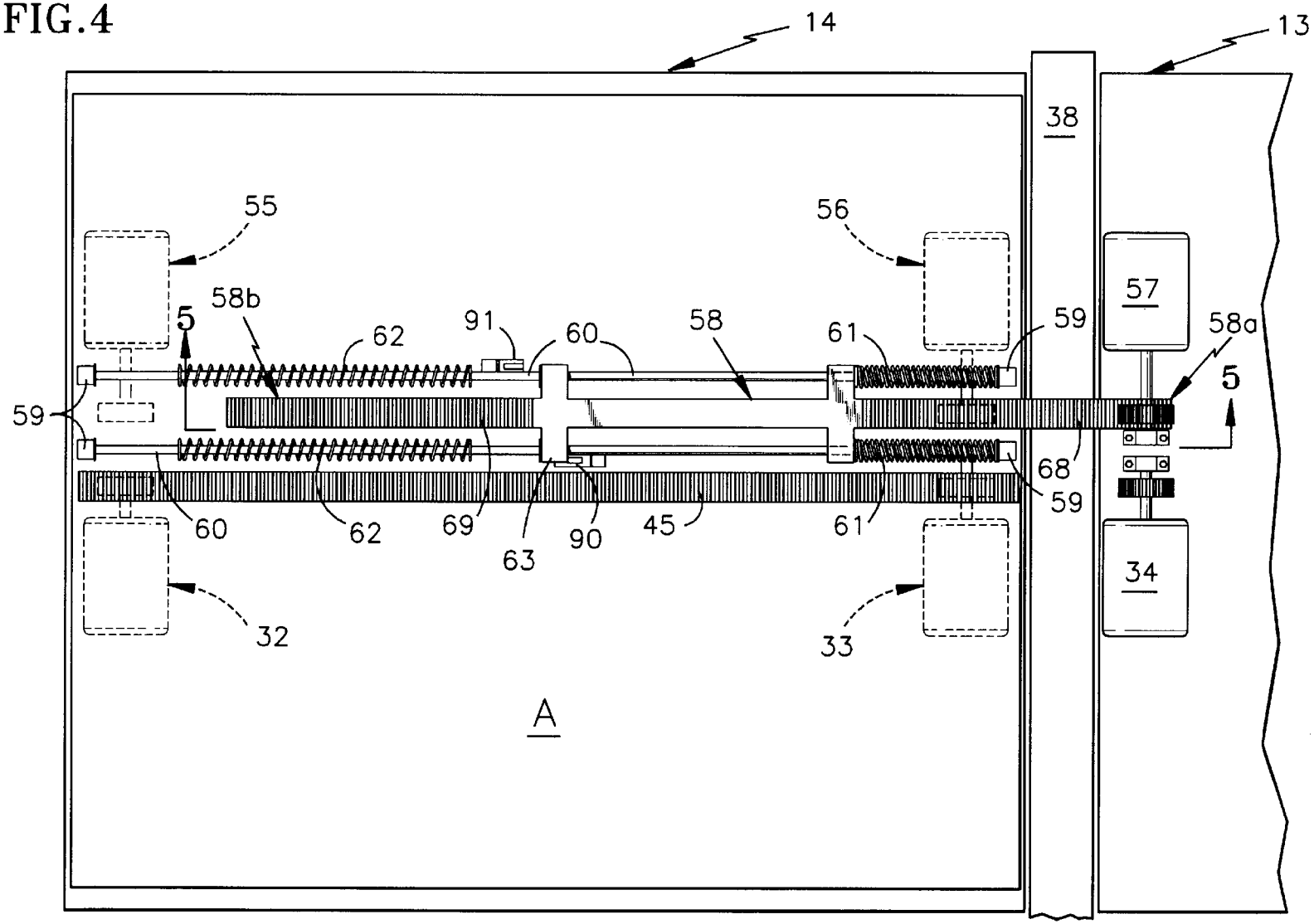
FIG. 4 is a view of the apparatus of FIG. 2, in the first step of operation for transferring a cab to the right.
Figure 5:
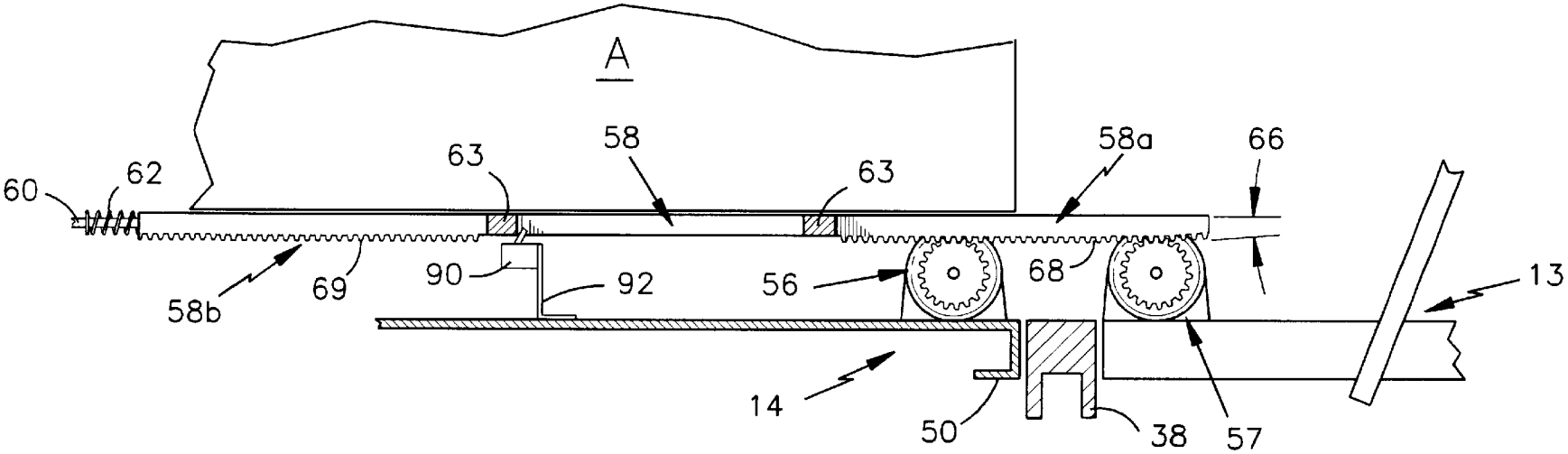
FIG. 5 is a simplified, partial, partially sectioned side elevation view of the apparatus as depicted in FIG. 4, taken on the line 5—5 in FIG. 4, showing the auxiliary rack and the pinions that operate it.

Normally, the auxiliary rack member 58 is more or less centered (it not being critical within a few centimeters) by the balanced force of the springs 61, 62, and friction. When a transfer of a cab to the right (as depicted in FIG. 1) is to take place, the motorized pinion 56 will rotate clockwise advancing the position of the auxiliary rack 58 to the right to a point where it is engaged by the motorized pinion 57, as shown in FIGS. 4 and 5. To assist the racks in engaging the pinions without excessive wear, all of the racks 45, 58*a*, 58*b* are tapered at the ends slightly, as illustrated by the arrows 66 in FIG. 5. In this process, the springs 61 are fully compressed as illustrated in FIG. 4, whereas the springs 62 float loosely on the rods 60. During this time, the cab A, and the stationary rack 45 thereon, have not moved at all.

Figure 6:
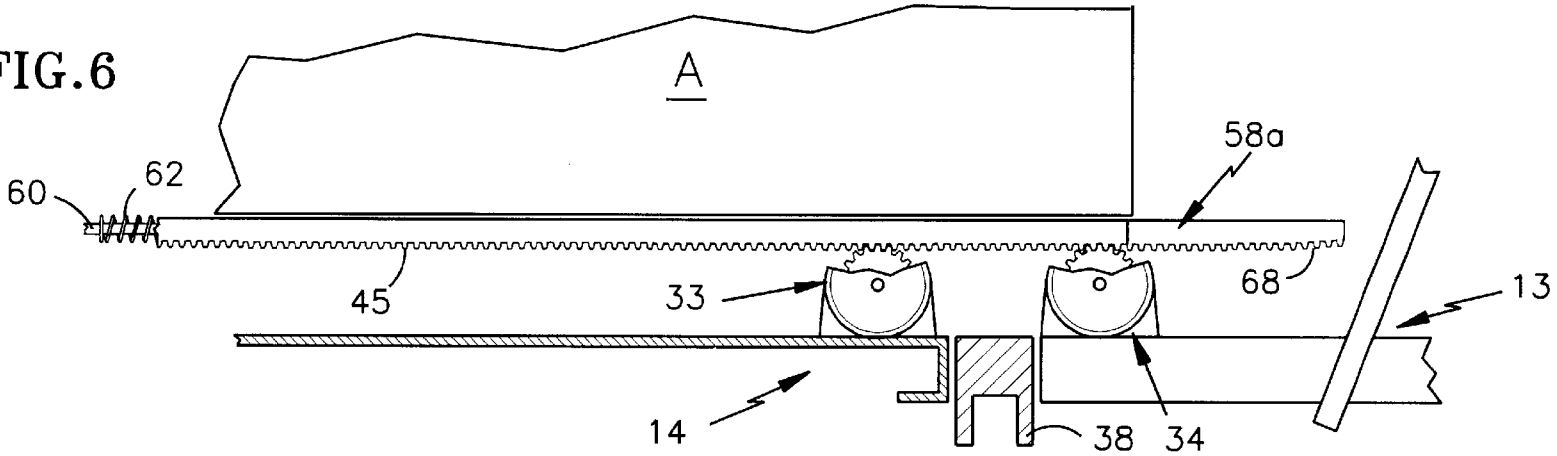
FIG. 6 is a simplified, partial, partially sectioned side elevation view of the apparatus as depicted in FIG. 4, showing the main rack and its operating pinions, after the cab has actually begun to move to the right.

Once the auxiliary rack 58*a* engages the motorized pinion 57 on the side where the cab is heading (FIG. 5), the pinion rotates clockwise to draw the cab A onto the car frame 13 as shown in FIG. 6. According to one aspect of the invention, the auxiliary racks 58*a*, 58*b* have sets of gear teeth 68, 69 each being sufficient to allow engaging an adjacent motorized pinion, but not sufficient to allow propelling the cab from the car frame on which it presently resides. As seen in FIG. 5, the teeth 68 extend just enough so that the motorized pinion 56 can drive the rack 58*a* into engagement with the motorized pinion 57. If the motorized pinion 56 continues to turn counterclockwise, it will simply become adjacent to a portion of the auxiliary rack member 58 which has no teeth, and therefore the cab will not move any further. This feature of the invention prevents any platform from shooting a cab off itself into an empty adjacent hoistway.

Once the auxiliary rack 58*a* has engaged the motorized pinion 57, the motorized pinion 57 will rotate clockwise to draw the cab to the right, to the position shown in FIG. 6. Then the motorized pinion 34 will rotate clockwise until the cab A is disposed fully on the car frame 13. When motorized pinion 34 starts moving the main rack 45, the auxiliary rack 58*a* will run out of teeth 68 engaged with the auxiliary rack 57, and the spring 61 will push the auxiliary rack 58 to its original position on the cab. Note that the motorized pinion 33 has played no part in this transfer, and is present only to draw the cab A back onto the car frame 14, at a different time. On the other hand, both of the motorized pinions 56 and 57 rotate clockwise in the process of first drawing the auxiliary rack 58*a* into position so the auxiliary rack 58*a* can pull the cab to the point where the main rack 45 is engaged by the main motorized pinion 34.

To transfer a cab to the left, the auxiliary rack 58*b* is moved to the left by counterclockwise rotation of the auxiliary motorized pinion 57 until it engages the auxiliary motorized pinion 56. Then the auxiliary motorized pinion 56 is rotated counterclockwise until it pulls the cab sufficiently to the left so that the main rack 45 engages the main motorized pinion 33. Then the main motorized pinion 33 is rotated counterclockwise until the cab is entirely placed on the car frame 14. The odd numbered motorized pinions 31, 33, 35 play no part in moving the cab to the right, and the even numbered motorized pinions 32, 34 and 36 play no part in moving the cab to the left. The auxiliary pinions are used in both directions to first move the auxiliary rack into contact with an opposing auxiliary motorized pinion which then pulls the cab sufficiently so that the main rack will engage a main motorized pinion.

Figure 9A:
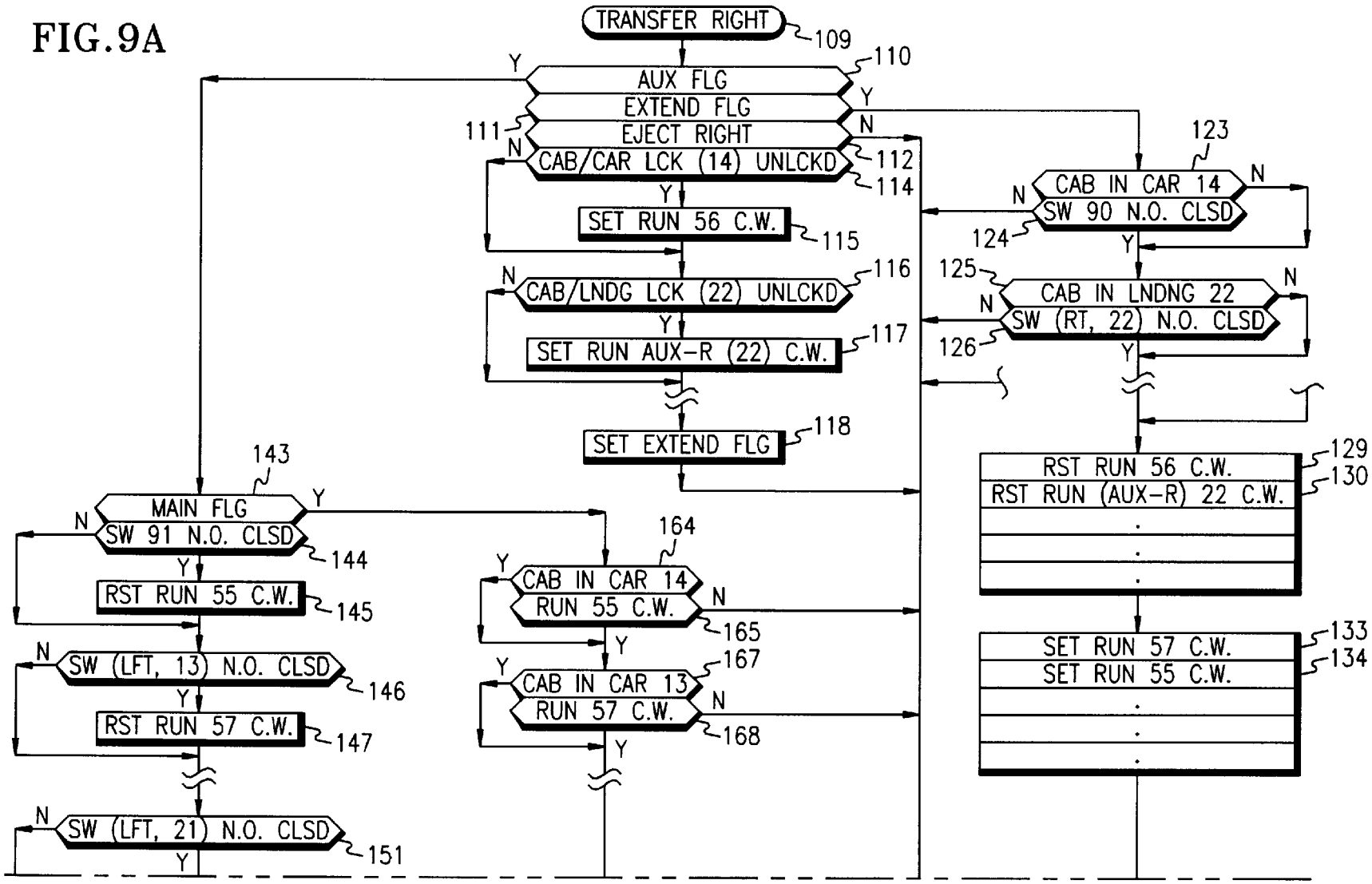
FIG. 9 is a logic flow diagram of an exemplary routine for causing a transfer to the right in accordance with the invention.
Figure 9B:
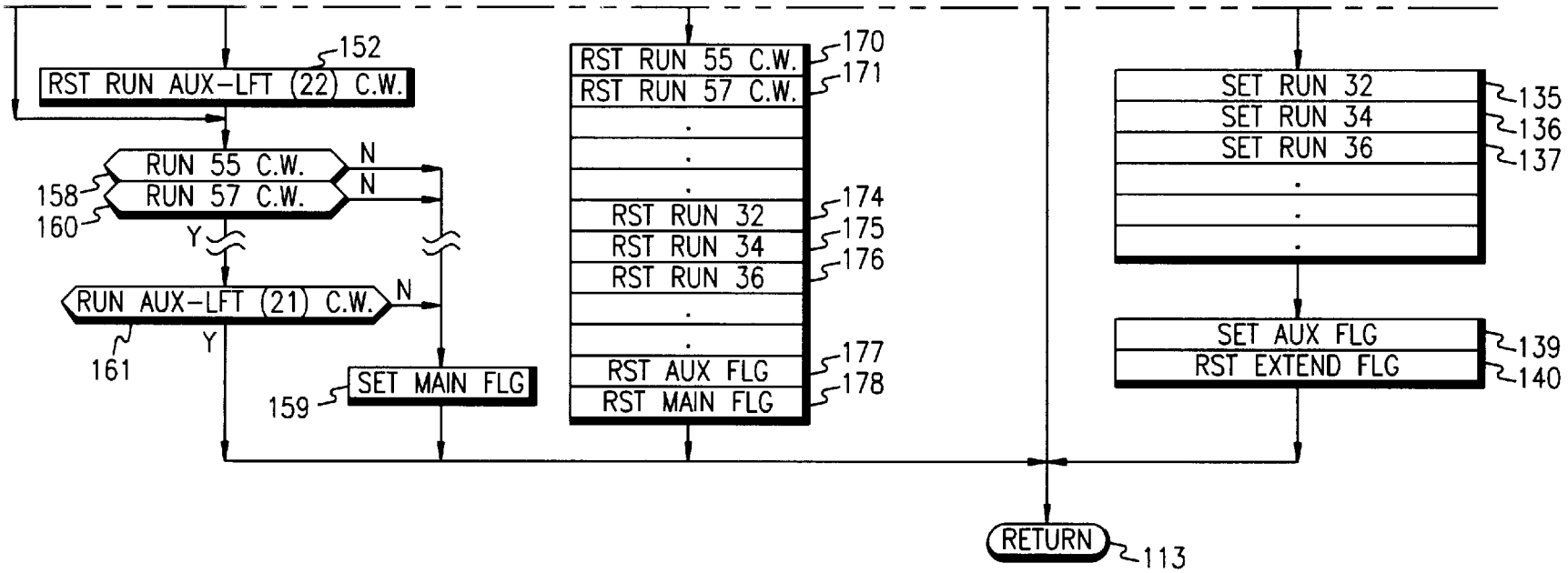
Figure 9:
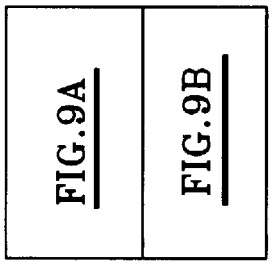

The programs in the aforementioned applications, and in other commonly owned U.S. patent applications which refer to this invention, provide a single step to order the transfer of the cab to the right or the left, such as a step "eject RT", to cause the occurrence of a transfer to the right. In order to control the horizontal motive means of the present invention in the sequences described hereinbefore, the controller of the one or several elevators which transfer cabs between landings and/or car frames requires a routine to accommodate it. An example of the functions which may be performed by such a routine is illustrated in FIG. 9.

To control such a routine, sensors are provided on the platforms and on the cabs to determine the stages of a transfer. As seen in FIG. 1, each platform has a position sensor 81–84 which cooperates with a related position sensor 85–87 on each of the cabs. The position sensors 82–87 cooperate to provide signals only when a cab is fully centered on a platform. The position sensors 81–87 may comprise proximity detectors, suitably cammed microswitches, photoelectric devices, and the like. The position sensors 81–87 collectively provide signals indicative of the cab being on the platform, such as "cab on car frame 14", "cab on car frame 13", "cab on landing 21", "cab on landing 22". Signals of this sort are used in the main programs in the aforementioned and other copending applications for controlling overall shuttle operation. Such signals are used herein to control motorized pinions.

In order to determine when the auxiliary rack 58 is extended to the right or to the left sufficiently to engage the motorized pinion (such as 57) which pulls it outwardly from under the cab, a right limit switch 90 (shown in FIGS. 2, 4 and 5 only) and a left limit switch 91 (shown only in FIGS. 2 and 4) are operated by lugs 63 of the auxiliary rack member 58. The switch 90 may be fastened by a suitable bracket 92 (FIG. 5) to a platform (car frame or landing). The switches 90, 91 may have a normally closed contact that brakes the power to the related motorized pinion, such as switch 90 braking the power line to motorized pinion 56 during a right move and switch 91 braking the power line to motorized pinion 55 during a left move. The switches 90, 91 may also have normally open contacts to be used in the control algorithm for advancing the operation and for synchronization, as described hereinafter.

Figure 7:
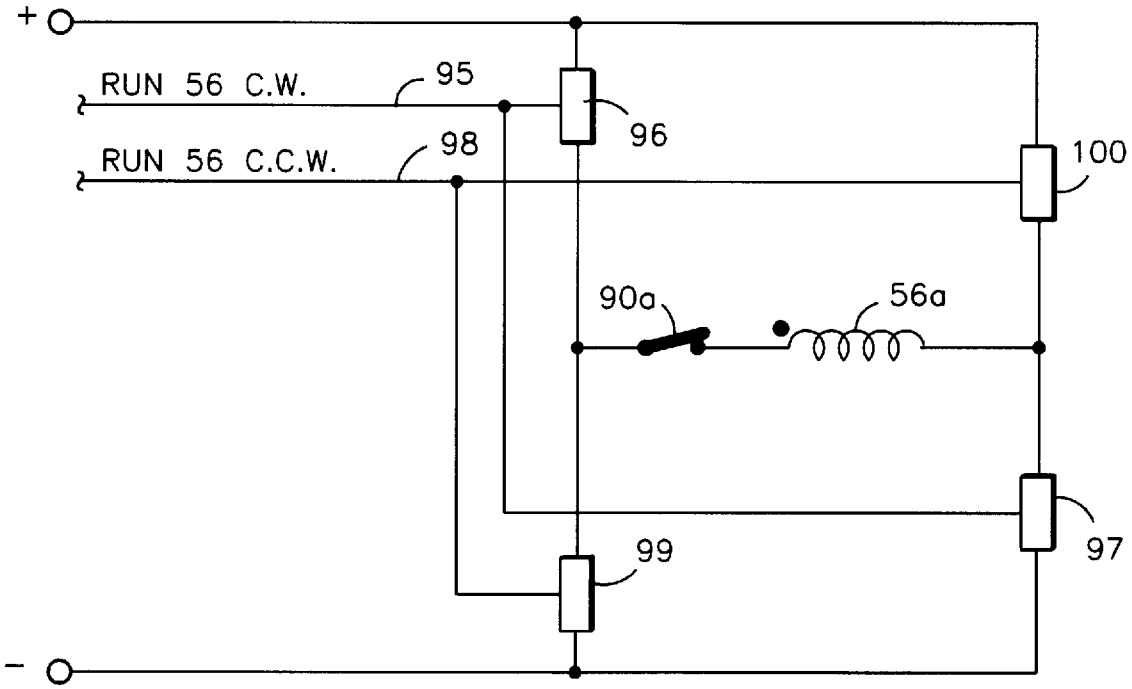
FIG. 7 is a simplified schematic diagram of circuitry for operating an auxiliary motorized pinion.

FIG. 7 shows an exemplary modality for operating the auxiliary motor 56 in either of two directions as needed. Therein, the armature 56*a* of the motorized pinion 56 is connected in a bridge in series with the normally closed contact 90a of the switch 90. When a cab is to be moved to the right (as in the foregoing examples), a "run 56 C.W." (clockwise) signal is provided on a line 95 to a pair of switches 96, 97 that connect the armature from plus to minus according to the known dot notation. On the other hand, when a cab is being transferred to the left, onto the car frame 14, a run 56 counterclockwise signal on a line 98 is provided to a pair of switches 99, 100 so as to cause the armature 56*a* to be connected from minus to plus, according to the dot notation, as shown. The purpose of the normally closed contact 90*a* is to turn off the motor 56 when the auxiliary rack 58*a* has been extended sufficiently so that its teeth engage with the teeth of the motorized pinion 57, at which point, one of the lugs 63 (FIG. 4) will actuate switch 90, opening the contact 90*a*. The switch 90, and similar switches 91 (and otherwise, not shown), also have a normally open contact which is used in the control. All of the other auxiliary motorized pinions have control circuits similar to that described for the motorized pinion 56 in FIG. 7.

Figure 8:
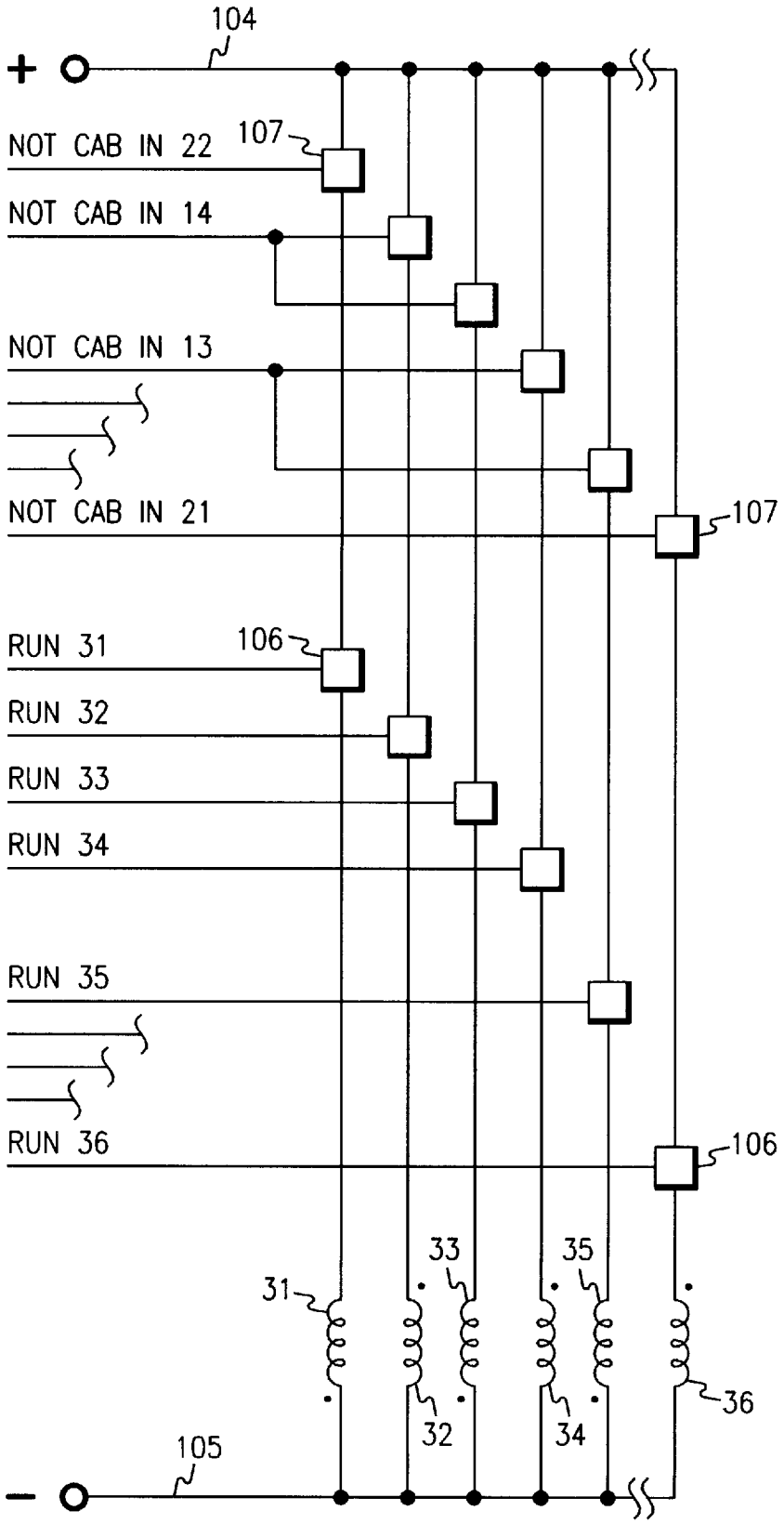
FIG. 8 is a simplified schematic diagram of circuitry for operating the main motorized pinions.

Referring now to FIG. 8, each of the motors of the main motorized pinions 31–36 are wired in between plus and minus circuits 104, 105 to rotate either counterclockwise (31, 33, 35) or clockwise (32, 34, 36). Each of the armatures is controlled by a pair of switches, a first switch 106 responding to a run command for the corresponding motor, and a second switch 107 operating both as an interlock and a control to prevent the motor from running whenever a cab is fully on the corresponding car frame. Thus, a motor (34) which normally can only pull a cab onto a car frame (to the right) cannot inadvertently start and push the cab slightly (to the left) which could pose significant danger. The other function of the switches 107 is to stop the motors when the cab is fully in place on a landing or a car frame. Referring to FIG. 9, an exemplary routine illustrative of functions which may be performed in a universally useful control algorithm for the horizontal motive means of the present invention is shown. The routine is reached through an entry point 109, and a first pair of tests 110, 111 determine if a pair of flags (used to advance the program and described hereinafter) have been set or not. Initially they will not have been, so a test 112 determines if a command has been given such as "eject right", to cause the cabs in the system to be moved to the right. If not, other programming is reached through a return point 113. In the present embodiment, it is assumed, as illustrated in the aforementioned copending U.S. patent application Serial No. (Attorney Docket No. OT-2296), that all cabs can be moved simultaneously either to the right or to the left. However, similar operation can obtain when some are moved right and some are moved left simply by separating the functions which are about to be described. In a double deck embodiment, as in said application, when all the lower cabs move to the right all the upper cabs move to the left, a separate routine for the upper and lower cabs, similar to that which is about to be described may be utilized. And, synchronization can be provided between them in obvious ways, if desired.

In FIG. 9, once a command has been given to move cabs to the right, an affirmative result of test 112 reaches a test 114 to see if the cab/car lock on the car frame 14 is unlocked or not. The purpose of this is to allow cabs to stay in place rather than moving them, when necessary during start up, shut down or other special operations, as is described in the aforementioned application Serial No. (Attorney Docket No. OT-2296). If the cab is locked, then it will not be moved, so its motor that extends the auxiliary rack will not be turned on. On the other hand, if it is to move, an affirmative result of test 114, for instance, will reach a corresponding step 115 to set a command to run motorized pinion 56 clockwise, which is the command provided to the line 95 in FIG. 7. This command will stay present until it is reset. Similarly, a test 116 determines if the cab landing lock for the landing 22 is unlocked. If so, the test 117 will set its auxiliary right hand motorized pinion to run clockwise in the same fashion as motorized pinion 56. But if not, then a negative result of test 116 will bypass step 117. Other steps and tests are performed for all of the platforms (landings and car frames) in the system. When that is complete, a step 118 sets an extend flag. Then other programming is reverted to through the return point 113, during which time the auxiliary racks are being moved to the right as described hereinbefore with respect to FIGS. 4 and 5.

In the next subsequent pass through the routine of FIG. 9, test 110 is still negative but test 111 is now positive reaching a step 123 to see if there is a cab in car 14. If there is, a test 124 determines if the normally open contact of switch 90 has been closed yet, or not. The purpose for this is to determine when the auxiliary rack for car 14 has been fully extended. But, if there were no cab on car frame 14, then of course there is no auxiliary rack to be extended; for this reason, if there is no cab, a negative result of test 123 bypasses the test 124. Similarly, a pair of tests 125 and 126 determine that either the landing 22 is empty, or it has had its switch operated by a fully extended auxiliary rack. Otherwise, negative results of either test 124 or test 126 cause other programming to be reverted to through a return point 119. Similar tests are provided for every other platform in the system. When all of them have either no cab in the platform, or its right hand switch has been operated, a step 129 will reset the "run 56 C.W." command, which will permanently turn off the motorized pinion 56, even though the normally closed contact 90*a* has already turned it off. A step 130 will reset the run clockwise command for the right hand auxiliary motorized pinion on the landing 22. And similar steps will reset the run commands for all of the right auxiliary motorized pinions in the system. At this point, all of the auxiliary racks in the system have been extended and are engaging the motorized pinions of the adjacent platforms. In this embodiment, all of the cabs are moved simultaneously at this point. In other embodiments, each cab could be allowed to begin moving as soon as it possibly could, simply by turning on the left hand auxiliary motorized pinions (such as 57 in FIGS. 4 and 5) so that the cab will begin to be pulled off its platform immediately.

In this embodiment, synchronized operation of all the cabs begins with a set of steps 133, 134 which set the motorized pinions 55 and 57 to run clockwise, such signals being applied to lines similar to line 95 in circuits similar to FIG. 7 for those motorized pinions. Then, in a series of steps 135–137 and additional steps, all of the right main motorized pinions 32, 34, 36 and others are set to run by providing signals to the switches 106 in FIG. 8. Then, an auxiliary flag is set in a step 139 and the extend flag is reset in a step 140, and other programming is reached through the return point 113.

In the next subsequent pass through the routine of FIG. 9, test 110 is positive, reaching a test 143 to see if a main flag has been set or not. Initially it will not have been, so a negative result of test 143 reaches a test 144 to see if the normally open contact of switch 91 has closed. With respect to car frame 14 and its left auxiliary motorized pinion 55, it should be apparent that by the time the right hand lug 63 of the auxiliary rack member 58 on the cab which is moving from the landing 22 onto the car frame 14 passes the switch 91, the cab B will be sufficiently moved to the right that it can be propelled by the main motorized pinion 32, and therefore the auxiliary motorized pinion 55 may be turned off. Thus, an affirmative result of test 144 reaches a step 145 to reset the "run 55 C.W." command. If the routine of FIG. 9 is not repeated sufficiently frequently to ensure that the test 144 will be reached during any period of time that the right hand lug 63 passes the switch 91 during transfer of cab C onto car frame 14, then the status of switch 91 may be latched electronically so as to accommodate the asynchronous operation. A similar test 146 determines if the normally open contacts of the left switch on the car frame 13 has closed or not. If it has, then the command to run 57 C.W. is reset in a step 147. Until the auxiliary rack 58 of car C passes the switch 91, a negative result of test 146 will bypass the step 147. Similar steps and tests are provided, such as test 151 and step 152 for the auxiliary motorized pinion on the left landing, for all of the landings and cars in the system.

When all have been processed, a test 158 determines if the run 55 clockwise signal is still present. If it is not, a negative result of test 158 will reach a step 159 to set the main flag. But if motorized pinion 55 is still running, a negative result of test 158 reaches a test 160 to see if motorized pinion 57 is still running, or not. If it is, other tests, such as a test 161 for the left exit motor on the landing 21 are reached. The purpose of all the tests 158, 160, 161 is to determine if any of the auxiliary racks have reached the point where the right hand lug will have operated a switch such as switch 91. If any has, it is now possible to switch operation by setting the main flag in the step 159. But until at least one of the auxiliary racks has reached that far, which assures that the main motorized pinions are capable of pulling the cabs by virtue of the main racks 45, then affirmative results of all of the tests 158, 160, 161 will simply cause other programming to be reached through the return point 113.

Once the main flag has been set, in the next pass through the routine of FIG. 9, test 110 is still positive and test 143 is now positive reaching steps which determine when all of the car frames have received cabs (if they are going to), thereby signaling the end of the transfer right operation. A test 164 senses if there is a cab fully in place on the car frame 14. Initially, all the cabs will be in motion, between one platform and the next, so that test 164 will be negative. However, in the event that no cab was being transferred from the landing 22 to the car frame 14 (which can occur in certain circumstances), there never will be a cab in car 14 during this operation of the transfer right routine. To test for that situation, a negative result of test 164 reaches a test 165 which determines whether, after at least some of the auxiliary motors have been turned off (in the tests and steps 143–152), the related auxiliary motorized pinion 55 has had its run command reset or not. Since there is no operational mode in which one cab can lag the others by that amount, an indication of the run command for one of the auxiliary motorized pinions not being reset at this point in the routine is an indication that there is no cab being transferred by that auxiliary motorized pinion. Therefore, an affirmative result of test 165 can be taken as an indication that car frame 14 is as loaded as it is going to be (empty), and also utilized to reset the run command for motorized pinion 55, in a step 166. In the usual case, a negative result of both tests 164 and 165 simply means that the cab has not completed its transfer to the right, but probably will do so, so a negative result of test 165 bypasses the remainder of the program through the return point 113. Then a step 167 determines if there is a cab in car 13. If not, a test 168 determines if the run command for auxiliary motorized pinion 57 is still present. If so, it is also assumed that car 13 will not get a cab. In any event, after tests 164–169, and similar tests for all of the other platforms in the system, have been completed without negative results of the tests 165, 168 and so forth, then a plurality of steps 170, 171 (and similar steps) reset all of the right-transfer auxiliary motorized pinions, in case there were an empty car frame. Then steps 174–176 (and other similar steps) reset the run command for all of the main motors that transfer the cabs to the right, including 32, 34 and 36. And then, when all of the main right-hand motorized pinions have had their run commands reset, the auxiliary flag and main flag are both reset in a pair of steps 177, 178, and other programming is reached through the return point 113.

Figure 10:
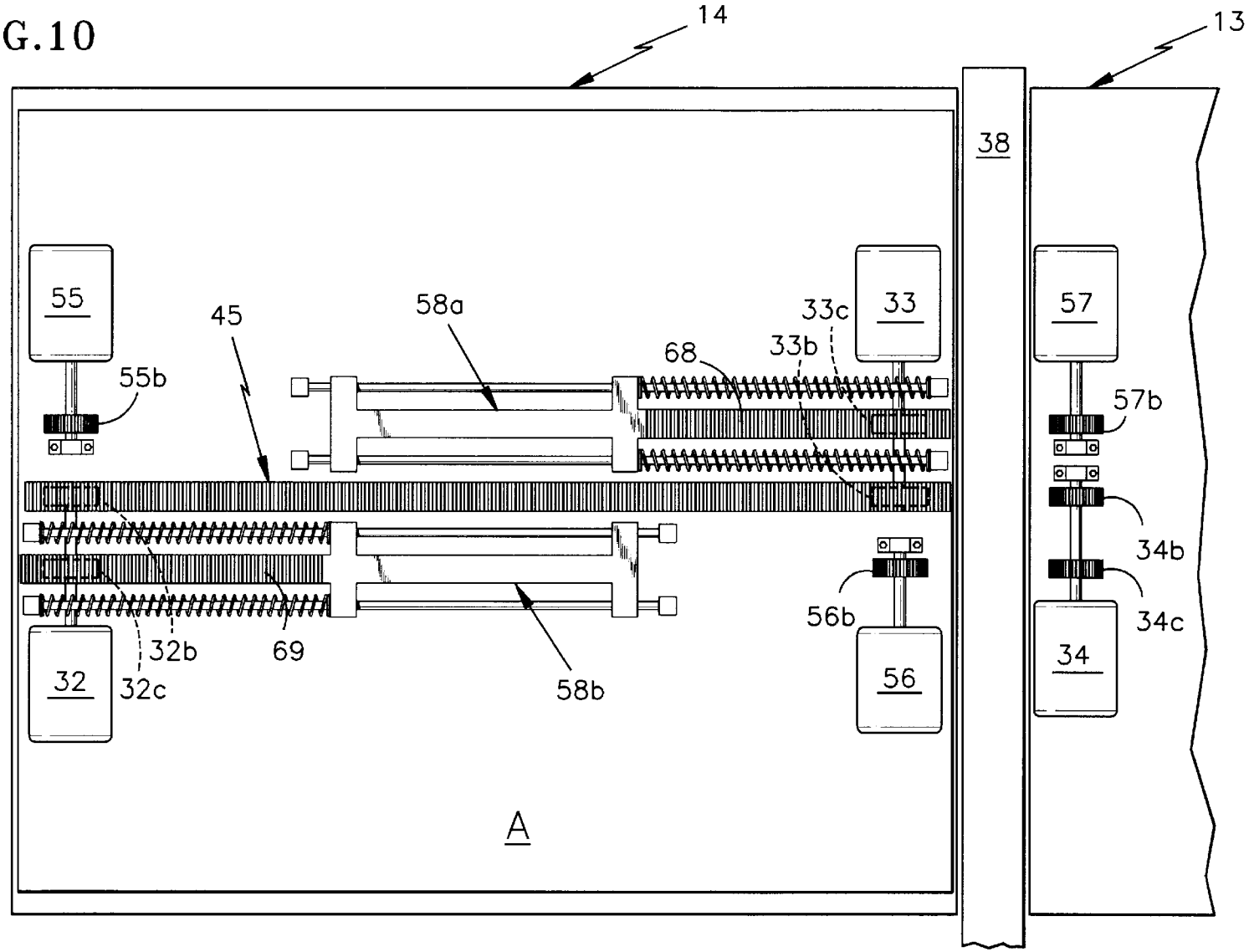
FIG. 10 is a simplified and stylized, top plan view of a horizontal elevator cab motion means according to another embodiment of the invention.

Since each of the secondary racks 58*a*, 58*b* works independently of the other, the two may be separated in any embodiment of the invention if desired, as is illustrated briefly in FIG. 10. The embodiment of FIG. 10 allows a much greater reach, such that the sill 38 (FIG. 1) could be almost as wide as a cab. It also avoids the need for careful positioning of the auxiliary racks 58*a*, 58*b*, when they are returned to their rest positions. In FIG. 10, the auxiliary rack teeth 68 are mounted on a shortened auxiliary rack 58*a* and the auxiliary rack teeth 69 are mounted on a shortened auxiliary rack 58*b*. In addition, the main motorized pinions 32*b*, 33*b*, 34*b* are driven by the same motors 32, 33, 34, as auxiliary pinions 32*c*, 33*c*, 34*c*. However, the main pinions 32*b*, 33*b*, 34*b* are driven by overrunning (one way) clutches, so they cannot push a cab off a platform. The auxiliary pinions 32*c*, 33*c*, 34*c* are driven by opposite overrunning clutches. When pulling a cab onto the corresponding platform, the auxiliary motorized pinions 32*c*, 33*c*, 34*c*, serve only to feed one of the auxiliary racks 58*a*, 58*b* across the interface to engage with a motorized pinion of the other platform. For instance, in the example given hereinbefore, the embodiment of FIG. 10 will have the motorized pinion 33*c* turn clockwise thereby causing the auxiliary rack 58*a* to engage the auxiliary pinion 34*c*, 57*b*; the main pinion 33*b* slips, so the main rack does not move. Then, the auxiliary pinion 57*b* will turn clockwise to draw the entire cab to the right until such time as the main rack 45 engages the main pinion 34*b*. At that point, the motor 33 will be idle, allowing the auxiliary rack 58*a* to be returned to its reset position under the cab (as shown in FIG. 10), as the main pinion 34*b* pulls the main rack 45 to the right, thereby loading the cab entirely onto the car frame 13. To return the cab to the left, the auxiliary motorized pinion 34*c* will turn counterclockwise (as main pinion 34*b* slips) causing the auxiliary rack 58*b* to extend to the left so that the pinion 51*c* engages it, and then pulls the cab to the left until such time as the main rack 45 engages the main pinion 33*a*, in the same fashion. Then motor 33 turns counterclockwise, the clutch on main pinion 33*b* does not slip, so it pulls the cab onto the car frame as shown in FIG. 10. During this process the auxiliary pinion 33*c* slips on its clutch so as to not interfere with teeth 68 moving to the left. In the embodiment of FIG. 10, the motorized pinions 32*b*, 33*c*, 34*b*, 55*b* and 57*b* only turn clockwise, and the motorized pinions 32*c*, 33*b* 34*c* and 56*b* only turn counterclockwise.

Figure 11:
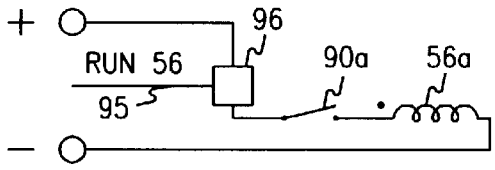
FIGS. 11–13 are modifications of FIGS. 7–9, respectively, for the embodiment of FIG. 10.

The circuits for running the auxiliary motors 55–57 in the embodiment of FIG. 10 are simpler than the previous embodiment, as shown in FIG. 11.

Figure 12:
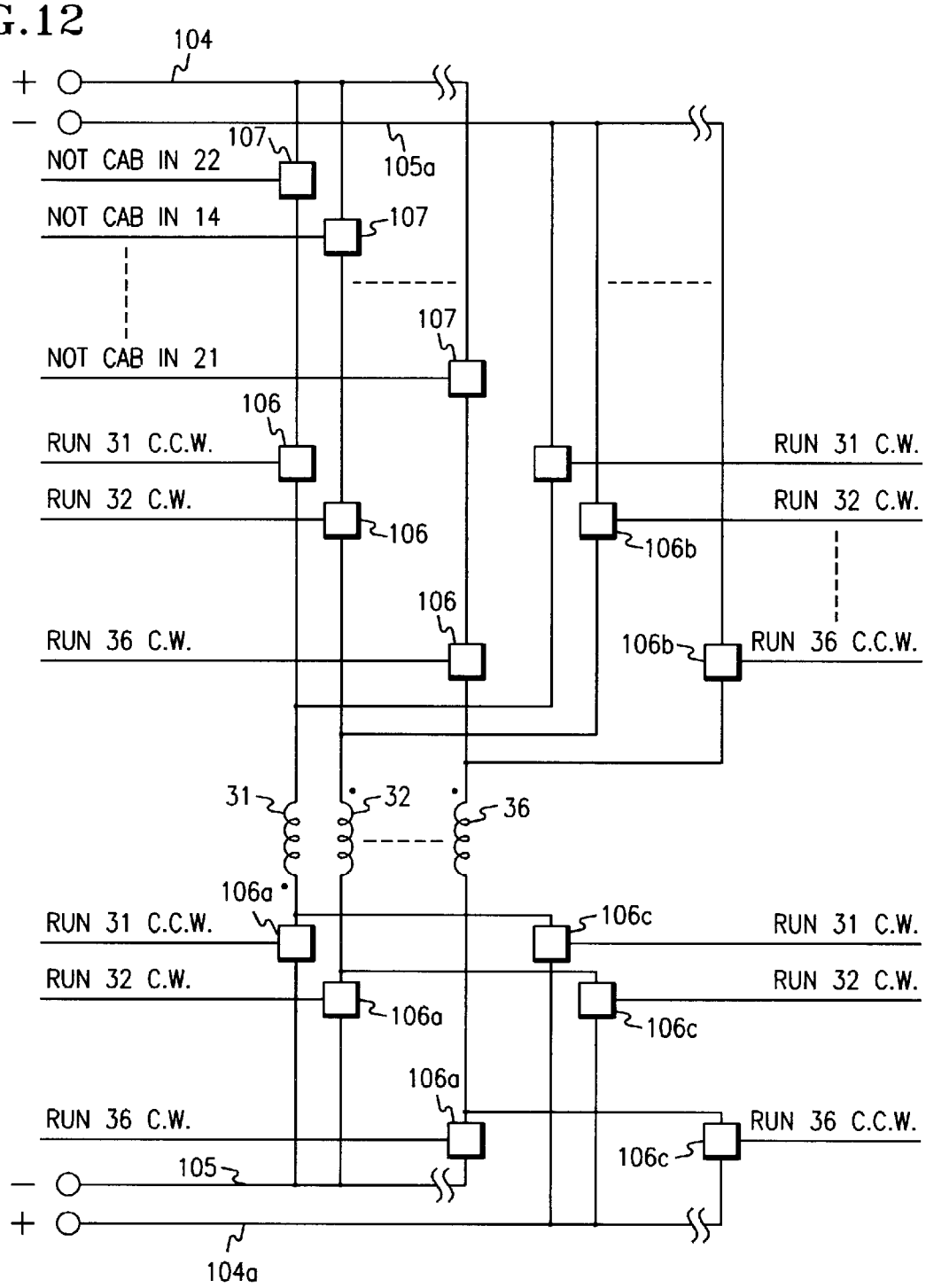
Figure 13A:
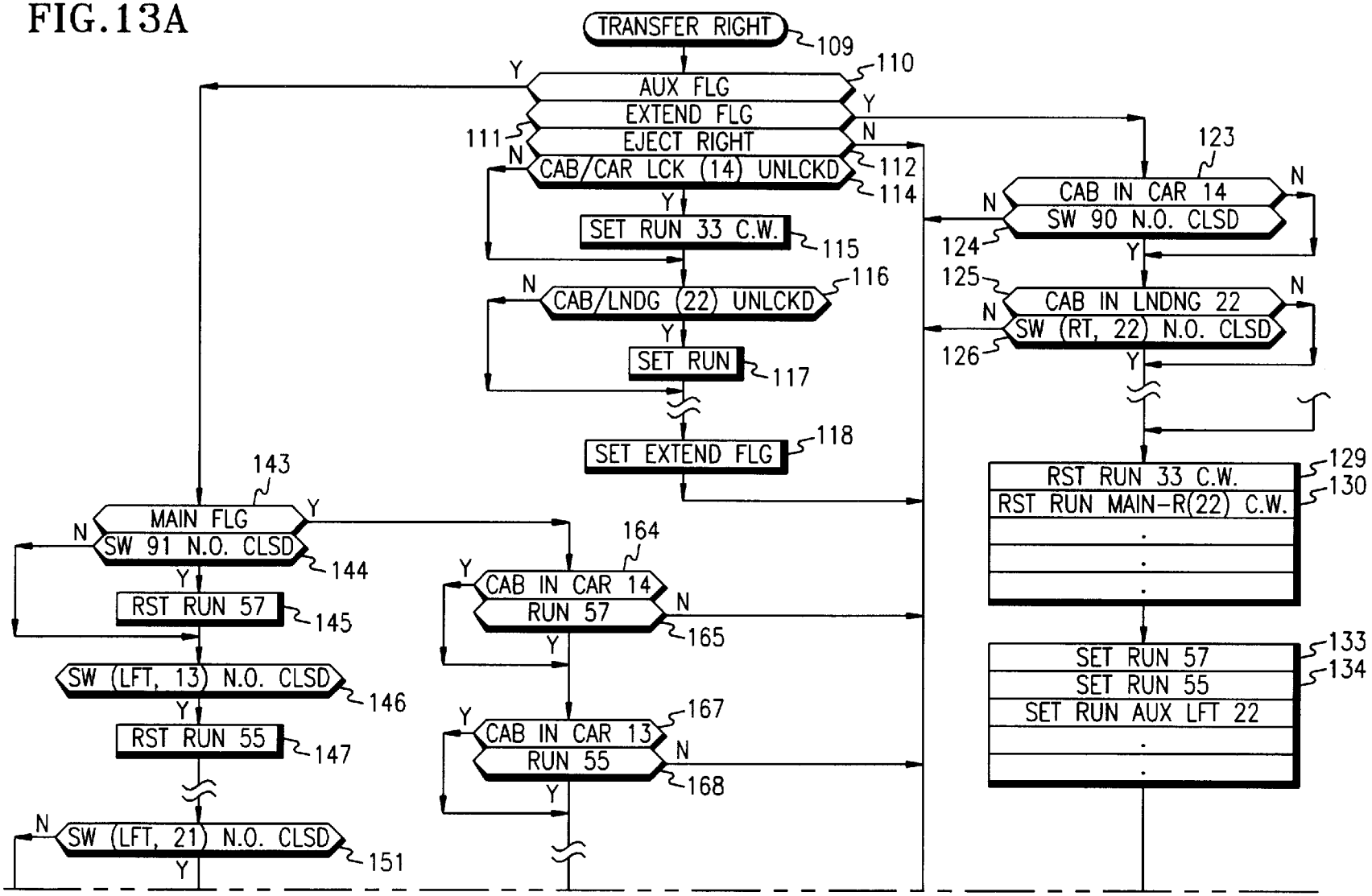
Figure 13B:
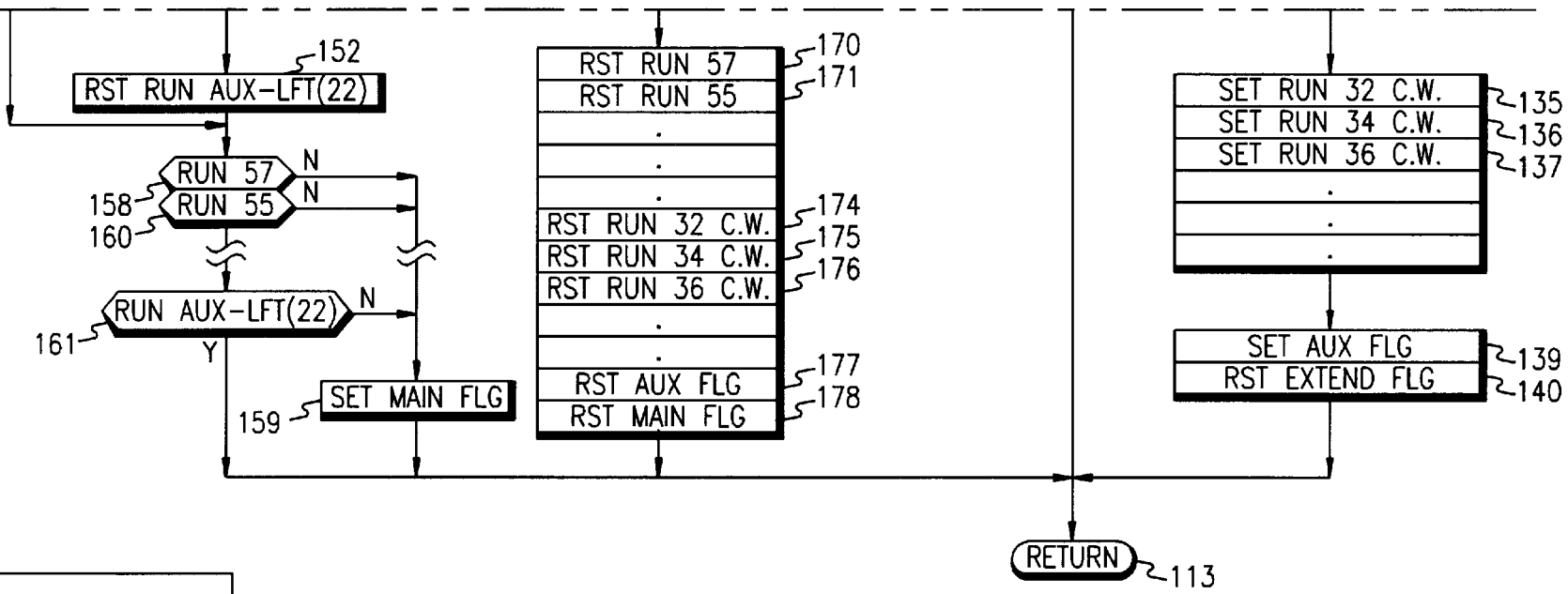
Figure 13:
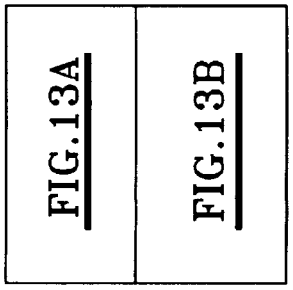

In FIG. 12, because of the fact that, in an embodiment represented by FIG. 10, each of the main pinion motors 31–36 need be operated initially in one direction to move an auxiliary back sufficiently so that an auxiliary pinion can move it further, the motors 3l–36 of FIG. 12 must be started by circuitry which bypasses the interlock switches 107. Furthermore, since each of the main motors 31–36 moves in one direction to advance an auxiliary rack and moves in the opposite direction to pull the main rack, the motors 31–36 must be driven with the correct polarity or voltage. Therefore, the switches 106 each work with a similar switch 106*b* to apply positive to negative of voltage across the windings of the motors 31–36 and additional switches 106*b*, 106*c* cooperate to provide negative to positive voltages across the windings of the motors 31, 36, when initially moving the auxiliary racks. This is an obvious extension of the polarized auxiliary motor operation referred to hereinbefore with respect to FIG. 7. Thus, switches 106*b* and 106*c* are provided to energize the motors when they are operated in one direction to initially move the auxiliary racks 58*a*, 58*b*, and switch 106, 106*a* are used to use the main pinions to pull the cab onto a frame. The routine of FIG. 13, for operating the embodiment of FIG. 10, is the same as that for operating the embodiment of FIGS. 1–9, as shown in FIG. 9, with the following exceptions. The auxiliary motorized pinions 55–57 no longer need directional commands, and the run 33 clockwise, run 35 clockwise, etc. commands are substituted for the run 56 clockwise, etc. commands and so forth. In FIG. 13, the substitutions have been made without renumbering, so the previous description with respect to the reference numerals is still appropriate and is not further described.

To transfer a cab to the left, the tasks of the motorized pinions are changed appropriately, and the direction changed to counterclockwise, all in an obvious fashion in view of the description of FIG. 9, hereinbefore.

In the foregoing description, the left-to-right and right-to-left directions of FIGS. 1, 2 and 4–6 have been referred to as "sides", and may refer to one side of the hoistways or another. The invention has been described in an embodiment in which the racks extend from front to back (that is, door to door) of the elevator cabs; this definition is based on the necessity to roll a cab between the stiles 51. As used herein, the term "side" refers to the direction in which the cars roll, from one side of a hoistway to another side of the hoistway, as from left to right in FIGS. 1, 2 and 4–6, rather than on the position of the racks relative to the position of elevator cab doors. However, it should be understood that in any case, a reference of the orientation of the racks and the pinions is the reference of direction of motion of the cab as a consequence of the pinions acting on the racks. Thus, the racks can be mounted from side to side, front to back, or otherwise, and any reference to any of them includes the other.

The embodiments herein have the rack mounted on the bottom of the cab because it is more practical to have the pinions mounted on the platform area of the car frame, rather than suspended above the cab. However, the racks may be mounted above the cabs if desired while still taking advantage of and practicing the present invention, provided the pinions are disposed in proximity therewith as shown.

The invention has been described as moving elevator cabs from one platform to the next, whether both platforms be elevator car frames, or one of the elevator platforms is a car frame and one of the elevator platforms is a landing or a carrier, and without regard to whether the car frame is pulled onto a landing or carrier, or is pulled from a landing or carrier onto a car frame. Thus, the invention relates to platforms, including car frames, carriers and landings. The platform may also be a carrier for moving a cab horizontally some distance or in an orthogonal direction, as in a commonly owned, copending U.S. patent application Serial No. (Attorney Docket No. OT-2287), filed contemporaneously with this continuation-in-part application.

In the disclosed embodiment, some of the motorized pinions are unidirectional, capable of turning only in a direction to pull a cab onto the corresponding platform, or, even if operated when it should not be, to push the cab only slightly off the opposite side of the platform. For additional safety, the main motorized pinions may all be provided with unidirectional clutches in all embodiments, if desired. If desired, the pinions may be engaged to the motors by means of clutches, rather than timing the moving of the racks by turning the motors on and off. Further, if the pitch of the racks and pinion gears and the diameter of the pinion gear is selected appropriately, the auxiliary pinions can be provided with single revolution clutches, instead of being turned on and off, if desired. All of this is irrelevant to the present invention. The pinions, particularly the auxiliary pinions, need not be rotary, but may in fact be linear, operable by any sort of linear actuator, electric or hydraulic, or the auxiliary rack/pinion function can be performed by other sorts of members.

In the embodiment of FIG. 10, the auxiliary pinion 34*c* is shown being driven on the same shaft as the main pinion 34*b*, as are the auxiliary pinion 33*c* and main pinion 33*b*.

However, this is not necessary, and still other arrangements may be utilized.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system, comprising:

a pair of elevator platforms;

an elevator cab, disposed on one of said elevator platforms, said cab capable of being moved horizontally in a first direction leading from a first one of said platforms to a second one of said platforms;

an elongated main rack fixed to said cab and extending across substantially an entire dimension of said cab parallel with said first direction, said platforms separated by a distance parallel to said first direction which is less than said dimension;

a first elongated auxiliary rack slidably disposed on said cab in a manner to be moveable in said first direction;

a first auxiliary pinion disposed on said first platform and operable to move said first auxiliary rack in said first direction relative to said cab;

a first main pinion disposed on said second platform in alignment with said main rack with said cab on said first platform, said first main pinion operable, when engaged with said main rack, to draw said main rack, and therefore said cab, onto said second platform; and a second auxiliary pinion disposed on said second platform and operable, when engaged with said first auxiliary rack, to move said first auxiliary rack in said first direction relative to said platforms, said first auxiliary rack being moveable in said first direction by said first auxiliary pinion only a limited distance sufficient to engage said second auxiliary pinion, said second auxiliary pinion moving said first auxiliary rack and said cab a sufficient distance in said first direction so that said main rack engages said first main pinion, said first main pinion thereafter moving said cab onto said second platform.

2. An elevator system according to claim 1 wherein:

said cab is capable of being moved horizontally in a second direction opposite to said first direction leading from said second platform to said first platform; and further comprising:

a second elongated auxiliary rack slidably disposed on said cab in a manner to be moveable in said second direction;

a third auxiliary pinion disposed on said second platform and operable to move said second auxiliary rack in said second direction relative to said cab;

a second main pinion disposed on said first platform in alignment with said main rack with said cab on said second platform, said second main pinion operable, when engaged with said main rack, to draw said main rack, and therefore said cab, onto said first platform; and a fourth auxiliary pinion disposed on said first platform and operable, when engaged with said second auxiliary rack, to move said second auxiliary rack in said second direction relative to said platforms, said second auxiliary rack being moveable in said second direction by said second auxiliary pinion only a limited distance sufficient to engage said fourth auxiliary pinion, said fourth auxiliary pinion moving said second auxiliary rack and said cab a sufficient distance in said second direction so that said main rack engages said second main pinion, said second main pinion thereafter moving said cab onto said first platform.

3. A system according to claim 2 wherein said first auxiliary pinion and said second main pinion are driven by the same shaft.

4. A system according to claim 3 wherein said thrid auxiliary pinion and said first main pinion are driven by the same shaft.

5. A system according to claim 1, further comprising:

a second elongated auxiliary rack slidably disposed on said cab in a manner to be moveable in said second direction; and a second main pinion disposed on said first platform in alignment with said main rack with said cab on said second platform, said second main pinion operable, when engaged with said main rack, to draw said main rack, and therefore said cab, onto said first platform; and wherein:

said cab is capable of being moved horizontally in a second direction opposite to said first direction leading from said second platform to said first platform;

said second auxiliary pinion is operable to move said second auxiliary rack in said second direction relative to said cab; and said first auxiliary pinion is operable, when engaged with said second auxiliary rack, to move said second auxiliary rack in said second direction relative to said platforms, said second auxiliary rack being moveable in said second direction by said second auxiliary pinion only a limited distance sufficient to engage said first auxiliary pinion, said first auxiliary pinion moving said second auxiliary rack and said cab a sufficient distance in said second direction so that said main rack engages said second main pinion, said second main pinion thereafter moving said cab onto said first platform.

6. A system according to claim 5 wherein said first and second auxiliary racks are disposed on mutually opposite ends of a single auxiliary rack member.

7. An elevator system, comprising:

a pair of elevator platforms;

an elevator cab, disposed on one of said elevator platforms, said cab capable of being moved horizontally in a first direction leading from a first one of said platforms to a second one of said platforms;

an elongated rack fixed to said cab and extending across substantially an entire dimension of said cab parallel with said first direction, said platforms separated by a distance parallel to said first direction which is less than said dimension;

a member disposed on said cab in a manner to be moveable in said first direction;

first means disposed on said first platform and operable to move said member in said first direction relative to said cab;

a pinion disposed on said second platform in alignment with said rack with said cab on said first platform, said pinion operable, when engaged with said rack, to draw said rack, and therefore said cab, onto said second platform;

second means disposed on said second platform and operable, when engaged with said member, to move said member in said first direction relative to said platforms, said member being moveable in said first direction by said first means a distance sufficient to engage said second means, said second means moving said member and said cab a sufficient distance in said first direction so that said rack engages said pinion, said pinion thereafter moving said cab onto said second platform.

8. A method of moving an elevator cab between a pair of elevator platforms horizontally in a first direction leading from a first one of said platforms to a second one of said platforms, said cab having a dimension parallel with a first direction, said platforms separated by a distance parallel to said first direction which is less than said dimension, said method comprising:

fixing an elongated main rack to said cab, said rack extending across substantially said dimension;

disposing a pinion on said second platform in alignment with said main rack with said cab on said first platform, said pinion operable, when engaged with said main rack, to draw said main rack, and therefore said cab, onto said second platform;

extending a member from said first platform in said first direction to overlap with said second platforms;

from said second platform, pulling said cab toward said second platform by means of said member a sufficient distance in said first direction so that said main rack engages said pinion; and moving said cab onto said second platform by means of said pinion pulling on said rack.

9. An elevator system, comprising:

a pair of elevator platforms;

an elevator cab, disposed on one of said elevator platforms, said cab capable of being moved horizontally in a first direction leading from a first one of said platforms to a second one of said platforms;

a first member disposed on said cab in a manner to be moveable in said first direction;

a second member fixed to said cab;

first means disposed on said first platform and operable to move said first member in said first direction relative to said cab;

second means disposed on said second platform and when engaged with said second member, operable to draw said second member, and therefore said cab, onto said second platform;

third means disposed on said second platform and operable, when engaged with said first member, to move said first member in said first direction relative to said platforms, said first member being moveable in said first direction by said first means a distance sufficient to engage said third means, said third means moving said member and said cab a sufficient distance in said first direction so that said second means engages said second member, said second means thereafter moving said second member and said cab onto said second platform.

10. An elevator system according to claim 9 wherein:

said second member is a rack; and said second means is a pinion.

11. An elevator system according to claim 10 wherein:

said first member is a rack; and said first means is a pinion.

12. An elevator system according to claim 9 wherein:

said first member is a rack; and said first means is a pinion.

13. An elevator system according to claim 1 wherein two of said platforms are elevator car frames.

14. An elevator system according to claim 1 wherein said platforms include an elevator cab landing on a floor of a building.

15. An elevator system according to claim 1 further comprising:

a plurality of elevator cabs, each capable of being moved in either of said two directions between said platforms; and said platforms numbering one more than the number of said cabs.

* * * * *